United States Patent [19]

Bitel

[11] Patent Number: 4,838,444

[45] Date of Patent: Jun. 13, 1989

[54] FOOD SERVICE TRAY AND ASSEMBLY THEREOF

[75] Inventor: Vincent J. Bitel, Rockfall, Conn.

[73] Assignee: The Rogers Manufacturing Company, Rockfall, Conn.

[21] Appl. No.: 139,280

[22] Filed: Dec. 29, 1987

[51] Int. Cl.[4] ..... B65D 6/12

[52] U.S. Cl. ..... 220/4 E; 220/4 B; 220/20; 220/23.8; 206/562; 206/563; 206/518

[58] Field of Search ..... 220/4 C, 4 B, 4 E, 20, 220/23.8; 206/562, 563, 564, 561, 229, 217

[56] References Cited

U.S. PATENT DOCUMENTS

| | | | |
|---|---|---|---|
| Re. 30,962 | 6/1983 | Bridges . | |
| 3,265,281 | 8/1966 | Hohnjec | 229/2.5 |
| 3,305,124 | 2/1967 | Whiteford . | |
| 3,311,231 | 3/1967 | English | 217/265 X |
| 3,360,152 | 12/1967 | Leers . | |
| 3,484,015 | 12/1969 | Rowan . | |
| 3,876,130 | 4/1975 | Haase | 229/2.5 |
| 3,905,506 | 9/1975 | Florian . | |
| 3,908,852 | 9/1975 | Ricobene et al. . | |
| 4,014,450 | 3/1977 | Girotti et al. . | |
| 4,173,286 | 11/1979 | Stanko | 206/433 |
| 4,195,746 | 4/1980 | Cottrell . | |
| 4,216,763 | 8/1980 | Miklas . | |
| 4,294,371 | 10/1981 | Davis . | |
| 4,360,118 | 11/1982 | Stern . | |
| 4,476,989 | 10/1984 | Larsen . | |

FOREIGN PATENT DOCUMENTS

| | | | |
|---|---|---|---|
| 2507216 | 9/1976 | Fed. Rep. of Germany | 220/4 E |

*Primary Examiner*—Stephen Marcus

[57] ABSTRACT

A receptacle member, such as a plastic tray, is symmetrical about at least one axis and includes engagement elements of at least two, complementary interfittable forms. Two of the members are assembled in inverted, confronting relationship to one another so as to define compartments of regular configuration within the resultant container unit, which are symmetrical with respect to a medial plane therethrough.

13 Claims, 3 Drawing Sheets

FOOD SERVICE TRAY AND ASSEMBLY THEREOF

BACKGROUND OF THE INVENTION

Trays, dinner plates, and similar food service items are of course widely used on airplanes and other common carriers, as well as in the home and in a variety of institutional settings. They are normally formed with several recesses or pockets, adapted to receive a food portion or a food or beverage receptacle, and they are typically of one-piece construction and molded from a relatively inexpensive material, such as plastic, paperboard, or the like. In many instances it is desirable to provide a cover for such a tray or plate, to protect and confine the contents and/or for temperature maintenance.

A considerable variety of such food service items have been proposed heretofore, and in some instances they have been designated so that two of them can be assembled to provide both the base and also the cover for an integrated, container-like assembly. Illustrative of the prior art in this field are the following United States patents:

Whiteford U.S. Pat. No. 3,305,124 provides a food service tray having a plurality of molded recesses, with a liner disposed over its entire upper surface.

Leers U.S. Pat. No. 3,360,152 is directed to a plastic housing, comprised of identical trays which are locked together in opposed relationship by use of alternating ribs and recesses provided along the sidewall edges.

A container consisting of insulated top and bottom components, which have interlocking elements on outside flange portions, is disclosed in Rowan U.S. Pat. No. 3,484,015.

Florian U.S. Pat. No. 3,905,506 shows a tray, which is symmetrical relative to two perpendicular axes, having cells for carrying individual containers.

Ricobene et al U.S. Pat. No. 3,908,852 discloses a food container which may be assembled from identical top and bottom components having interfitting projections and recesses.

Girotti et al U.S. Pat. No. 4,014,450 provides a storage housing consisting of two identical containers positioned in inverted relationship to one another, a flange of each being engaged within a groove of the other.

Cottrell U.S. Pat. No. 4,195,746 discloses a stackable, tray-like container which has a projection along approximately half the length of its upper edge flange, and a recess along the other half, which will interlock when two of the trays are assembled.

A toaster/oven pan is provided by Miklas U.S. Pat. No. 4,216,763, which has handles that interengage when two of the pans are assembled in a confronting relationship to one another.

Davis U.S. Pat. No. 4,294,371 provides a nestable sundae dish with identical bottom and cover components, which can be secured in assembly by interengaging their locking elements.

Stern U.S. Pat. No. 4,360,118 is directed to a pizza container comprised of half-sections with interfitting flanges.

Larsen U.S. Pat. No. 4,476,989 discloses a pizza box assembled from identical carton halves, each of which has edges formed to provide projections and recesses which interlock with those of the opposite half.

Bridges U.S. Pat. No. Re. 30,962 provides insulated, stackable trays with sealing lips for holding and serving food.

Despite the activity indicated by the above-noted prior art, the need remains for an article, in the form of a tray, dinner plate, or like receptacle, which has a plurality of compartments and which can readily be assembled with an identical component to provide an assemble having a plurality of internal chambers.

It is therefore the broad object of the present invention to provide a novel receptacle member satisfying the foregoing need, and to provide a novel container-like assembly of two such articles.

It is a more specific object of the invention to provide such an article and assembly in which the chambers of the integrated unit, resulting from assembly of the articles, are of regular configuration and symmetric with respect to the plane at the intersection of the components.

Another object of the invention is to provide a novel article having the foregoing features and advantages, which is relatively facile and inexpensive to produce, and which is conveniently and effectively joined with an identical article to produce the container-like assembly.

SUMMARY OF THE INVENTION

It has now been found that certain of the foregoing and related objects of the invention are attained by the provision of a receptacle member comprised of a body divided by a medial axis into generally symmetrical sections, and having a peripheral portion thereabout with a plurality of engagement elements thereon lying substantially in a common reference plane. The body of the member also has compartmentation structure which defines a plurality of inwardly opening compartments within the peripheral portion and extending outwardly of the reference plane. The engagement elements are of at least two complementary, interengaging forms, and each element disposed on one of the symmetric sections of the body is transversely aligned with a complementary, interfittable element disposed on the other one, the complementary elements being equidistantly spaced from the medial axis. Both compartments of at least one pair are dimensioned and configured to exhibit mirror image identity to one another, as viewed from the reference plane, are equidistantly spaced from the axis, and are transversely aligned with one another in each of the lateral sections. As a result, two of the receptacle members, disposed in inverted, confronting relative orientations, can be assembled with one another, with the corresponding pairs of compartments in registry and with the engagement elements interengaged, to thereby cooperatively provide a pair of chambers within the assembly.

In preferred embodiments, certain of the complementary engagement elements on the body will be of rib-like form and will project inwardly from the peripheral portion, with the other elements being in the form of grooves recessed thereinto. Generally, there will be a plurality of engagement elements on each of the lateral sections of the body, with at least two of the elements on a section being of complementary, mutually interfittable construction. The engagement elements will most desirably extend along the entire length of the peripheral portion, and will be disposed closely adjacent one another thereon.

In one form the body will comprise a substantially planar component, providing both the peripheral portion and also the innermost elements of the compartmentation structure, the latter additionally including wall elements extending outwardly from the planar component. They may include an outer wall element and a sidewall element, extending therefrom to the peripheral portion; the sidewall element defining each of the "one" pair of compartments will typically be of continuous, irregular curvilinear contour, as viewed from the reference plane.

At least one of the compartments defined by the compartmentation structure may lie on the medial axis of the body, in which case it will have a configuration of mirror image symmetry with reference thereto. The body may be divided by a second medial axis, perpendicular to the first, into generally symmetrical transverse sections, to comprise quadrants dimensioned and configured to exhibit mirror image identity to one another, with respect to both of the medial axes. The engagement elements on each quadrant of such an article will be complementary to the engagement elements on the two of the quadrants that are contiguous to it.

Other objects of the invention are attained by the provision of an assembly comprised of first and second identical receptacle members, interengaged with one another in opposed relative orientations. Each member of the assembly will have the features hereinabove indicated, and more fully described hereinbelow.

DETAILED DESCRIPTION OF THE ILLUSTRATED EMBODIMENTS

Figure 1:
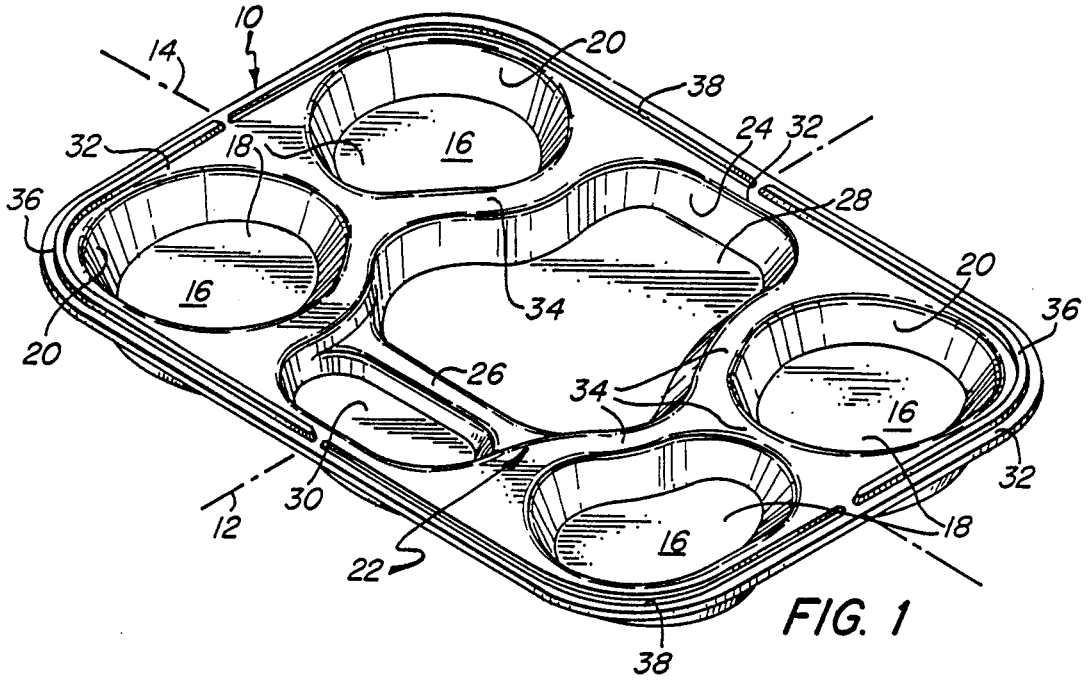
FIG. 1 is a perspective view of a tray embodying the present invention.
Figure 2:
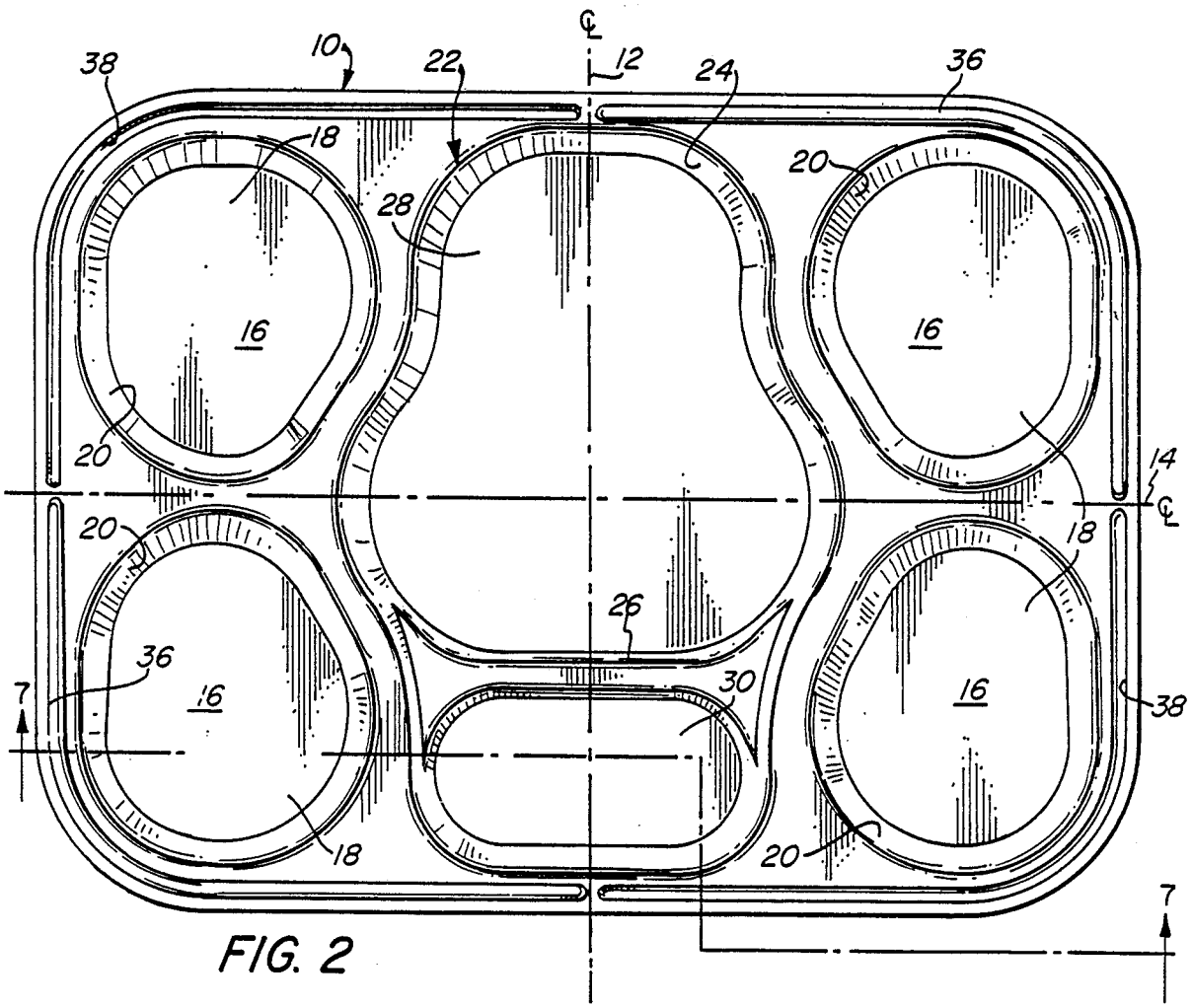
FIG. 2 is a plan view of the tray of FIG. 1.
Figure 3:
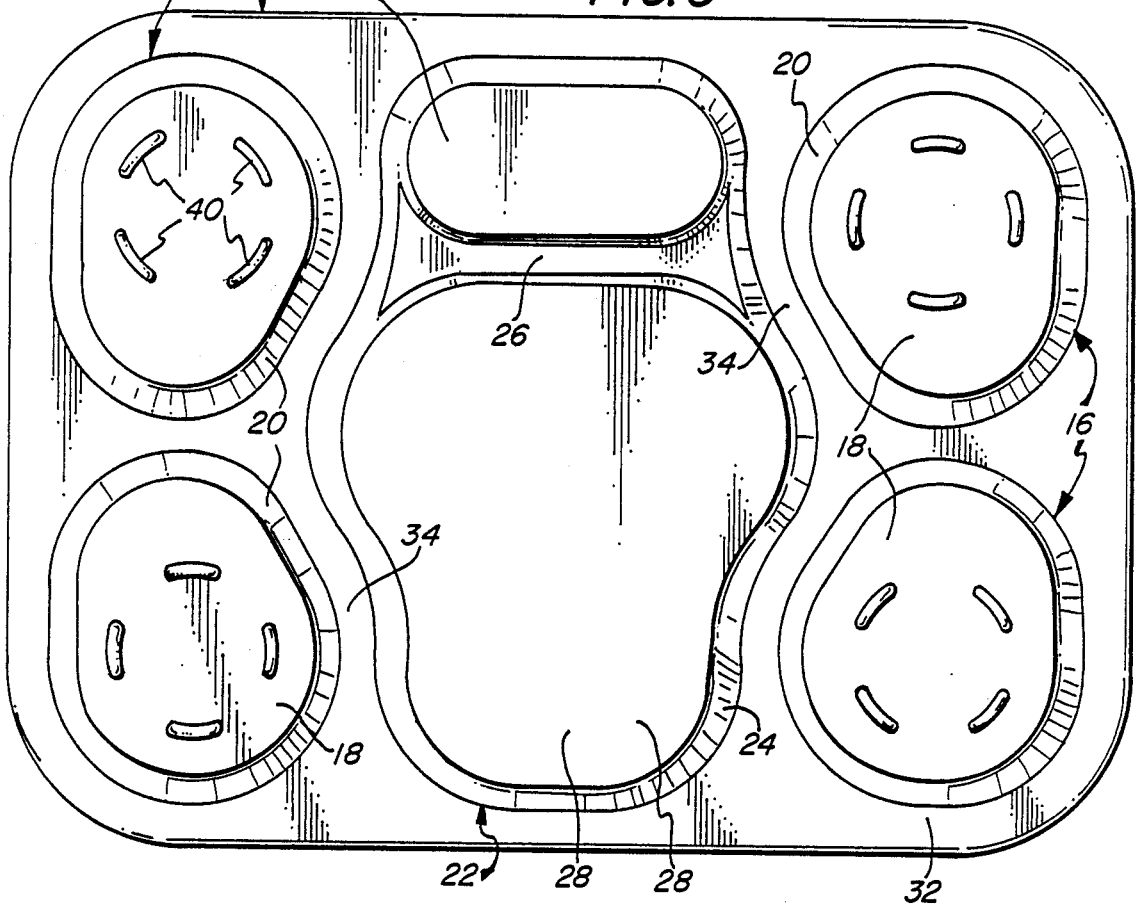
FIGS. 3, 4, 5 and 6 are, respectively, bottom, front, rear and side elevational views of the tray.
Figure 4:
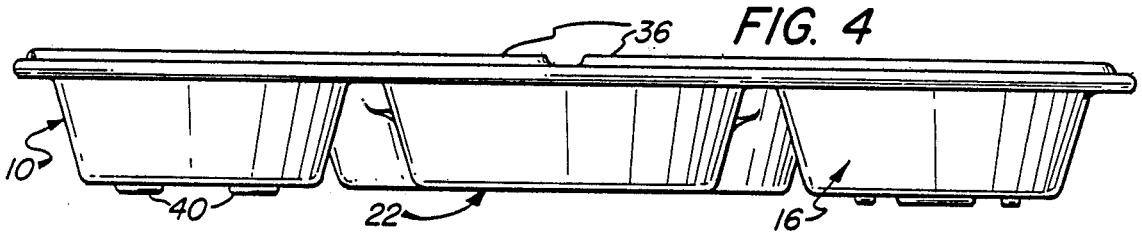
Figure 5:
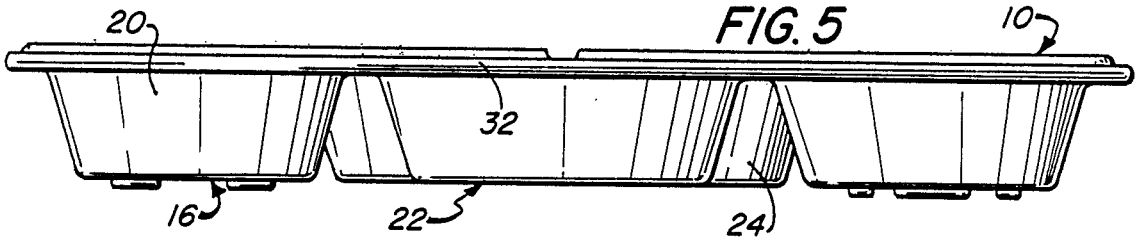
Figure 6:
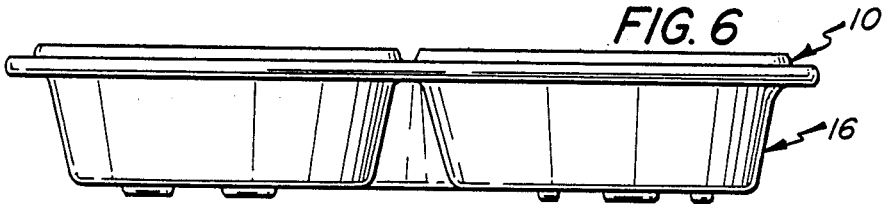
Figure 7:
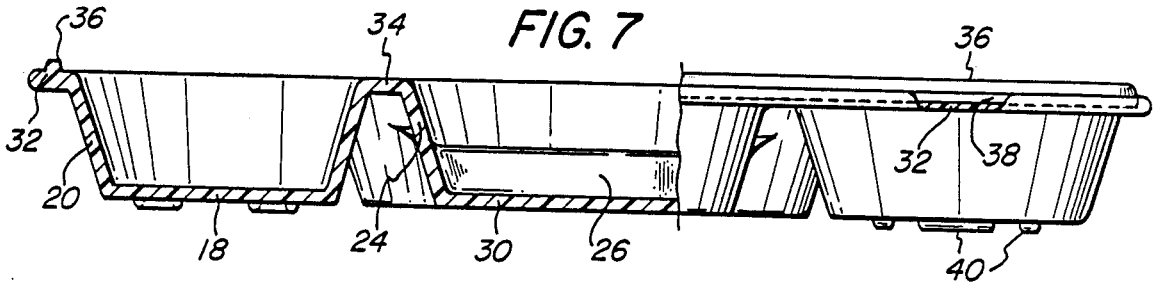
FIG. 7 is a front view of the tray, taken in partial section along line 7—7 of FIG. 2, with a flange portion broken away to show adjacent structure.

Turning now in greater detail to FIGS. 1–7 of the appended drawings, therein illustrated is a one-piece molded plastic tray embodying the present invention and consisting of a rounded corner rectangular body, generally designated by the numeral 10, divided into four quadrants by imaginary, mutually perpendicular medial axes or centerlines, 12 and 14. Each quadrant of the tray so defined has a relatively small pocket, generally designated by the numeral 16, formed into it and defined by a bottom wall 18 and a continuous, inwardly tapered peripheral wall 20 of irregular contour. As will be noted, the pockets 16 bear mirror image symmetry to one another, with reference to both of the centerlines 12, 14, and in regard to spacing therefrom as well as configuration.

A compound pocket, generally designated by the numeral 22, is formed into the central area of the panel 10, and is peripherally defined by a curvilinear, inwardly tapered sidewall 24, across which extends a relatively low ridge portion 26; the ridge portion subdivides the pocket 22 into a relatively large compartment, having a bottom wall portion 28, and a relatively small compartment having a bottom wall portion 30. It will be appreciated that the pocket 22 is fully symmetrical in a lateral sense (i.e., with respect to medial axis 12), and that it is peripherally symmetrical in a transverse sense (i.e., with respect to the perpendicular centerline 14), despite the apparent transverse dissymmetry presented by the subdividing ridge portion 26.

As will be appreciated, the tray is conveniently produced by formation of a planar plastic sheet to produce the pockets 16, 22, as by a vacuum molding or other appropriate thermoforming technique. The tooling used will cause other portions, namely the peripheral flange portion 32 and the innermost wall elements 34 of the compartmentation structure, to remain flat and to lie on a common plane, as shown. It will be noted that the elements 34 merge into one another and into the flange portion 32, with no clear demarcation thereamong. Four bosses 40 are formed in a circular pattern on the exterior surface of the outer wall 18 of each pocket 20, and serve of course to maintain separation between adjacent trays in a stack, and thereby to prevent frictional binding of one to another.

Engagement elements extend along substantially the entire length of the periphery of the tray and are of two complementary forms. A rib 36, of generally right-angular configuration, projects outwardly from the surface of the flange portion 32 at two nonadjacent corners of the tray, and provides a male element; two correspondingly configured grooves 38 are formed into the flange portion at the opposite nonadjacent corners, to provide female elements. The elements 36, 38 are of course so dimensioned that they would (if on separate components) interfit and frictionally interengage one another.

Figure 8:
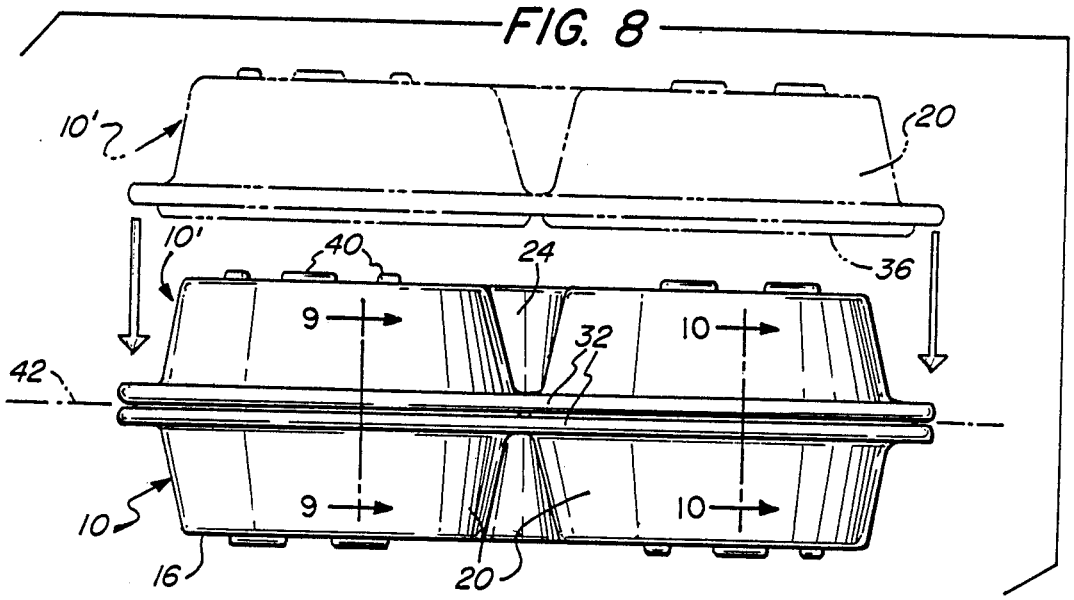
FIG. 8 is an end elevational view of an assembly of trays embodying the present invention, with the components engaged in inverted, confronting orientations relative to one another, the covering tray also being shown in phantom line in an elevated position displaced from the base component.
Figure 9:
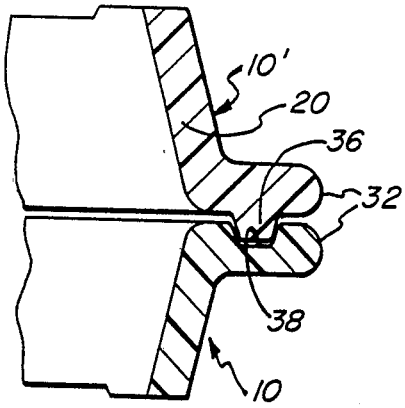
FIGS. 9 and 10 are fragmentary sectional views of the assembly taken, respectively, along lines 9—9 and 10—10 of FIG. 8, drawn to a scale enlarged therefrom and showing the interfitted engagement elements provided on the flange portions of the trays.
Figure 10:
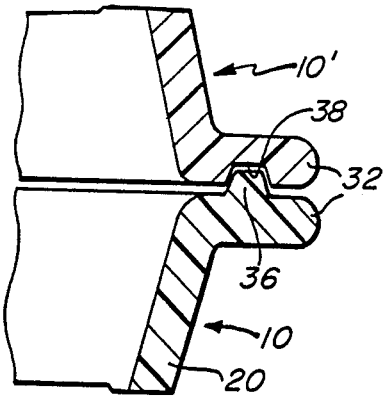

Turning now more specifically to FIGS. 8–10, an assembly is illustrated in which two trays 10, 10' of the invention are disposed in an inverse, confronting orientation to one another, and are joined by frictional interengagement of the rib and groove elements 36, 38, as described above. In the assembly, the pockets 16 of the covering tray 10' cooperate with those of the base tray 10 to produce chambers that are of regular configuration, with the confronting, innermost wall elements 34 surrounding the mouths of the pockets closely coentensive, due to the symmetry of construction of the component trays.

It will be appreciated that, because the cooperating pockets bear mirror image identity to one another, the resultant chambers will be symmetrical, as regarded from the opposite sides of the medial plane of the assembly (i.e., the common plane 42 at the intersection of the components). It will further be appreciated that there will be close peripheral conformity between the packets of all confronting pairs (including the compound central pockets) regardless of whether the two trays are assembled with the ridge portions 26 (subdividing the central pocket 22) aligned or offset from one another by rotating the cover and base relatively, through an angle of 180 degrees).

As indicated, in most instances the trays of the invention will be fabricated from a synthetic resinous material, normally by use of a thermoforming technique. It will be self-evident however that other materials, such as paperboard and the like, can be employed instead, utilizing suitable conventional fabrication techniques.

The article of the invention may of course take a wide variety of forms, different from the tray illustrated, such as that of a dinner plate. Also, while the one-piece, molded construction shown is regarded to be the best mode for carrying out the invention, an alternative construction might for example employ an arrangement of solid internal walls, joined to a separate bottom panel and surrounded by a sidewall. The interengageable elements provided for joining the components may also vary considerably from the form shown, and it is believed that numerous possibilities will be evident to those skilled in the art.

Thus, it can be seen that the present invention provides a novel tray, or similar form of receptacle member, having a plurality of compartments, which tray can readily be joined with an indentical component to provide an assembly within which a plurality of chambers, of regular and symmetric configuration, are defined. The receptacle member is relatively facile and inexpensive to produce, and two of them are conveniently and effectively assembled to produce the integrated, container-like unit described.

Having thus described the invention, what is claimed is:

1. A food service tray member comprised of a body divided by a medial axis into generally symmetrical sections, said body having a compartment portion and a peripheral flange portion extending thereabout, said flange portion having a plurality of engagement elements thereon originating in a common reference plane, said compartment portion having depending pockets formed therein and extending outwardly of said reference plane, and said pockets each having a depending peripheral wall and a base wall defining a plurality of compartments within said peripheral portion opening at said reference plane, said engagement elements being of at least two complementary, interengageable forms including elongated ribs projecting upwardly from said plane and elongated recesses extending downwardly from said plane and dimensioned and configured to seat said ribs, each element disposed on one of said sections being transversely aligned with a complementary, interfittable element disposed on the other of said sections, and said complementary elements being equidistantly spaced from said axis, at least one pair of pockets disposed on opposite sides of said medial axis being dimensioned and configured to exhibit mirror image identity to one another, as viewed in said plane, and being equidistantly spaced from said axis and being transversely aligned with one another in each of said sections, whereby said member can be assembled with a second said member inverted thereupon, with said engagement elements being interengaged and said compartments of at least said one pair being in cooperating registry, respectively, with the complementary elements and the compartments of a corresponding pair thereof of the second member, to provide a pair of chambers of regular configuration within the assembly, symmetrical as regarded from the opposite sides of the medial plane of the assembly.

2. The member of claim 1 wherein there are a plurality of said engagement elements on each of said sections, at least two of said elements on each said section being structurally complementary to one another and of interfittable construction.

3. The member of claim 2 wherein said engagement elements extend about substantially the entire length of said peripheral flange portion, and the ends thereof are disposed closely adjacent one another.

4. The member of claim 1 wherein said peripheral wall defining each of said one pair of compartments is of irregular contour, as viewed in said plane.

5. The member of claim 4 wherein said peripheral wall of each pocket defining said one pair of compartments is continuous, and said contour thereof is curvilinear.

6. The member of claim 1 wherein at least one of said compartments defined by a pocket lies on said medial axis, and wherein said one compartment has a configuration of mirror image symmetry with reference to said axis.

7. The member of claim 1 wherein said body is also divided by a second medial axis extending perpendicularly to said first-mentioned axis, into generally symmetrical transverse sections, said body thereby (consisting of quadrants dimensioned and configured to exhibit substantial mirror image identity to one another with respect to both of said medial axes,) said engagement elements on each of said quadrants being complementary to said engagement elements on the two of said quadrants that are contiguous to it.

8. A food service tray assembly comprised of first and second identical tray members interengaged in inverse, confronting relationship to one another, each of said members being comprised of a body divided by a medial axis into generally symmetrical sections, said body having a compartment portion and a peripheral flange portion extending thereabout, said flange portion having a plurality of engagement elements thereon originating in a common reference plane, and said compartment portion having depending pockets formed therein and extending outwardly of said reference plane, said pockets each having a depending peripheral wall and a base wall and defining a plurality of compartments within said peripheral portion opening at said reference plane, said engagement elements being of at least two complementary, interfittable forms including elongated ribs projecting upwardly from said plane and elongated recesses extending downwardly from said plane and dimensioned and configured to seat said ribs, each element disposed on one of said sections being transversely aligned with a complementary, interfitting element disposed on the other of said sections, and said complementary elements being equidistantly spaced from said axis, at least one pair of pockets disposed on opposite sides of said medial axis being dimensioned and configured to exhibit mirror image identity to one another, as viewed in said plane, and being equidistantly spaced from said axis, and being transversely aligned with one another in each of said sections whereby, with said first and second receptacle members assembled in inverse, confronting relationship with said compartments thereof opening toward one another, and with said engagement elements being interengaged and said compartments of at least said one pair of said first member being in registry, respectively, with said complementary elements and said compartments of the corresponding pair thereof of said second member, said pairs of compartments cooperatively providing a pair of chambers of regular configuration within said assembly, symmetrical as viewed from the opposite sides of the medial plane of said assembly.

9. The assembly of claim 8 wherein, in each of said members, said engagement elements extend about substantially the entire length of said peripheral flange portion of each of said members, and the ends thereof are disposed closely adjacent one another.

10. The assembly of claim 8 wherein there are a plurality of said engagement elements on each of said sections, at least two of said elements on each said section being structurally complementary to one another and of interfittable construction.

11. The assembly of claim 8 wherein said peripheral wall of said pockets is continuous and of irregular, curvilinear contour, as viewed in said reference plane.

12. The assembly of claim 8 wherein at least one of said compartments of each of said members, defined by a pocket, lies on said medial axis thereof, and wherein said one compartment has a configuration of mirror image symmetry with reference to said axis.

13. The assembly of claim 8 wherein said body of each of said members is also divided by a second medial axis extending perpendicularly to said first-mentioned axis, into generally symmetrical transverse sections, said body thereby consisting of quadrants dimensioned and configured to exhibit substantial mirror image identity to one another with respect to both of said medial axes, said engagement elements on each of said quadrants being complementary to said engagement elements on the two of said quandrants that are contiguous to it.

* * * * *